US007856193B2

(12) United States Patent
Kawamata

(10) Patent No.: US 7,856,193 B2
(45) Date of Patent: Dec. 21, 2010

(54) ENDLESS MEMBER DRIVING DEVICE AND IMAGE FORMING APPARATUS

(75) Inventor: Kunimasa Kawamata, Saitama (JP)

(73) Assignee: Fuji Xerox Co., Ltd., Tokyo (JP)

( * ) Notice: Subject to any disclaimer, the term of this patent is extended or adjusted under 35 U.S.C. 154(b) by 187 days.

(21) Appl. No.: 12/331,940

(22) Filed: Dec. 10, 2008

(65) Prior Publication Data

US 2009/0285596 A1 Nov. 19, 2009

(30) Foreign Application Priority Data

May 13, 2008 (JP) ..... P2008-126465

(51) Int. Cl.
*G03G 21/20* (2006.01)

(52) U.S. Cl. ..... 399/92

(58) Field of Classification Search ..... 399/92, 399/93

See application file for complete search history.

(56) References Cited

U.S. PATENT DOCUMENTS 6,463,230 B1 * 10/2002 Wargo ..... 399/92

7,190,918 B2 * 3/2007 Kimura et al. ..... 399/91

FOREIGN PATENT DOCUMENTS

JP 2005-241934 9/2005

* cited by examiner

*Primary Examiner*—Hoang Ngo
(74) *Attorney, Agent, or Firm*—Morgan, Lewis & Bockius LLP

(57) ABSTRACT

An endless member driving device, includes: an endless member that rotates by receiving a driving force; a cooling path that extends in a widthwise direction along at least one of an obverse surface and a reverse surface of the endless member; and a gas transfer unit that transfers a gas in the cooling path along the widthwise direction of the endless member, wherein the cooling path includes a downstream-side cooling path that is formed on a downstream side in a gas transferring direction of the cooling path, and the downstream-side cooling path being directed in an opposite direction to a moving direction of the obverse surface or the reverse surface of the endless member perpendicular to the widthwise direction with respect to the moving direction.

8 Claims, 12 Drawing Sheets

ENDLESS MEMBER DRIVING DEVICE AND IMAGE FORMING APPARATUS

CROSS-REFERENCE TO RELATED APPLICATION

This application is based on and claims priority under 35 USC 119 from Japanese Patent Application No. 2008-126465 filed May 13, 2008.

BACKGROUND

1. Technical Field

The present invention relates to an endless member driving device and an image forming apparatus.

2. Related Art

An image forming apparatus equipped with an endless member driving device having an endless member is conventionally known.

SUMMARY

According to an aspect of the invention, there is provided an endless member driving device, including: an endless member that rotates by receiving a driving force; a cooling path that extends in a widthwise direction along at least one of an obverse surface and a reverse surface of the endless member; and a gas transfer unit that transfers a gas in the cooling path along the widthwise direction of the endless member, wherein the cooling path includes a downstream-side cooling path that is formed on a downstream side in a gas transferring direction of the cooling path, and the downstream-side cooling path being directed in an opposite direction to a moving direction of the obverse surface or the reverse surface of the endless member perpendicular to the widthwise direction with respect to the moving direction.

BRIEF DESCRIPTION OF THE DRAWINGS

Exemplary embodiments of the present invention will be described in detail based on the following figures, wherein:

FIGS. 7A to 7C are diagrams explaining a state in which a belt module is removed from the unit supported inside the opening/closing section in accordance with the first embodiment of the invention, in which FIG. 7A is an explanatory perspective view, FIG. 7B is an enlarged explanatory view of an essential portion of a suction path portion, and FIG. 7C is a cross-sectional view taken along line VIIC-VIIC in FIG. 7B;

DETAILED DESCRIPTION

Figure 1:
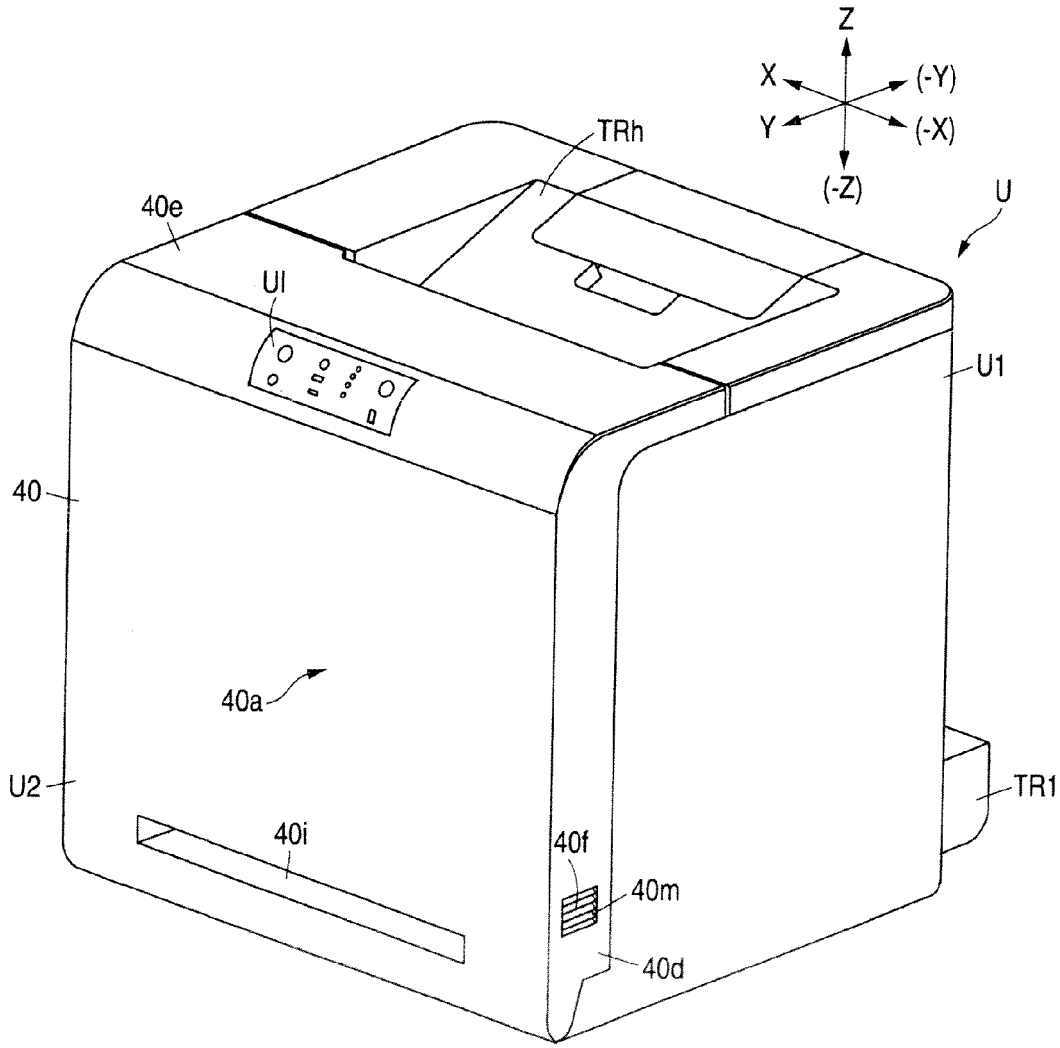
FIG. 1 is an overall perspective view of a printer in accordance with a first embodiment of the invention.

Hereafter, a description will be given of an exemplary embodiment (hereinafter referred to as an embodiment) of the invention, but the invention is not limited to the following embodiment.

It should be noted that, to facilitate an understanding of the description that follows, it is assumed that, in the drawings, the front-rear direction is an X-axis direction, the right-left direction is a Y-axis direction, and the vertical direction is a Z-axis direction, and that directions or sides which are respectively indicated by arrows X, -X, Y, -Y, Z, and -Z are a forward direction, a backward direction, a rightward direction, a leftward direction, an upward direction, and a downward direction, or a front side, a back side, a right side, a left side, an upper side, and a lower side, respectively.

In addition, it is also assumed that a mark in which a dot "•" is depicted in a circle "○" means an arrow which is directed from the rear side toward the front side of the plane of the drawing, and that a mark in which an "x" mark is depicted in a circle "○" means an arrow which is directed from the front side toward the rear side of the plane of the drawing.

It should be noted that, in the following description with reference to the drawings, the illustration of members other than those required for the description is omitted, where appropriate.

First Embodiment

FIG. 1 is an overall perspective view of a printer in accordance with a first embodiment of the invention.

In FIG. 1, a printer U in accordance with the first embodiment of an image forming apparatus of the invention has an image forming apparatus body U1. An opening/closing section U2, which is opened and closed about a rotating shaft U2*a* at a lower right end of the image forming apparatus body U1, is supported on a right surface of the image forming apparatus body U1. A sheet discharging unit TRh is provided on an upper surface of the image forming apparatus body U1, and a sheet feed tray TR1, in which a recording medium S as an exemplary medium on which an image is recorded is accommodated, is installed in a lower potion on a left side surface of the image forming apparatus body U1 in such a manner as to be capable of being inserted and withdrawn.

Figure 2:
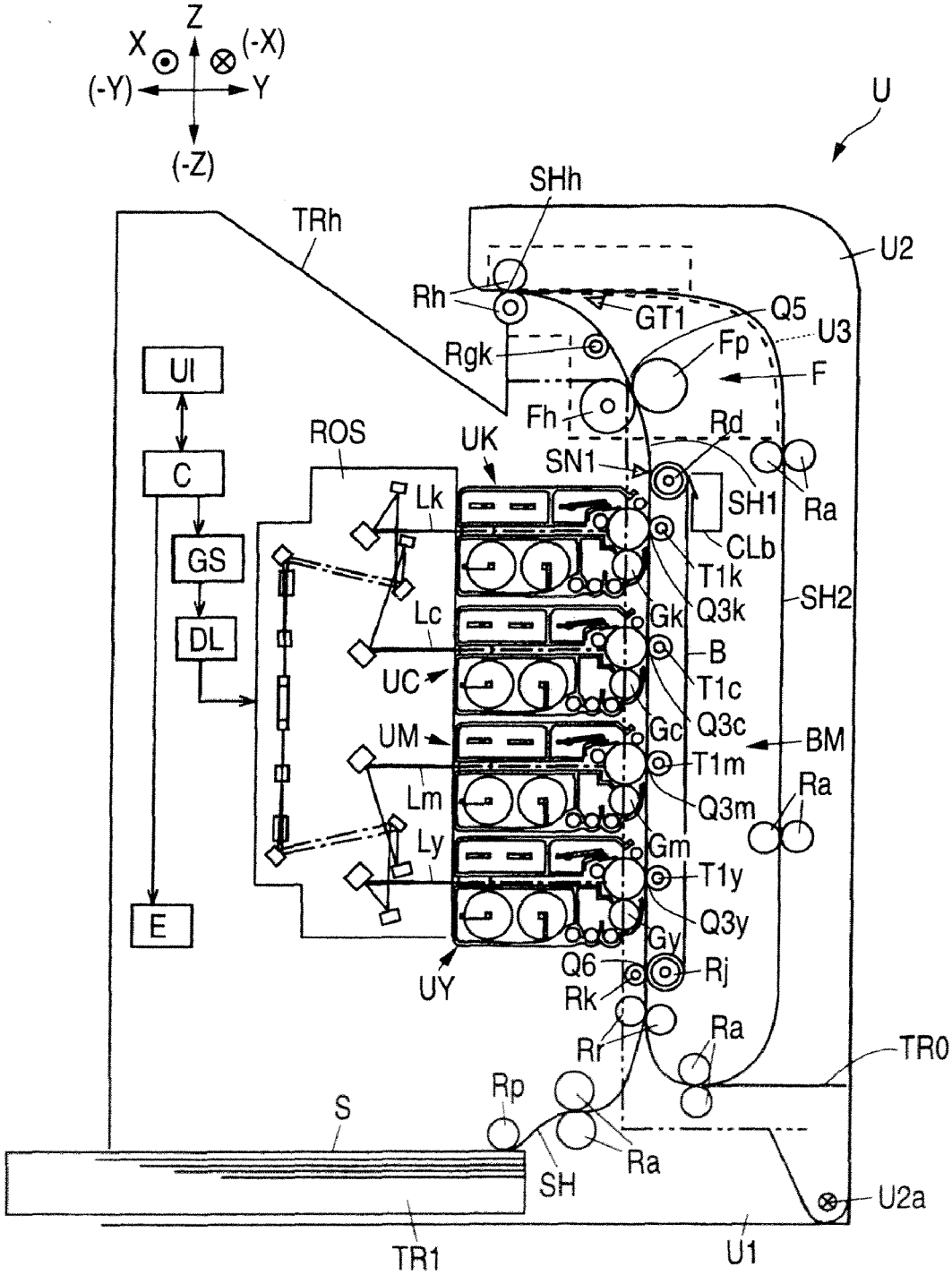
FIG. 2 is an overall explanatory diagram of an image forming apparatus in accordance with the first embodiment of the invention.

FIG. 2 is an overall explanatory diagram of the image forming apparatus in accordance with the first embodiment of the invention.

Figure 3:
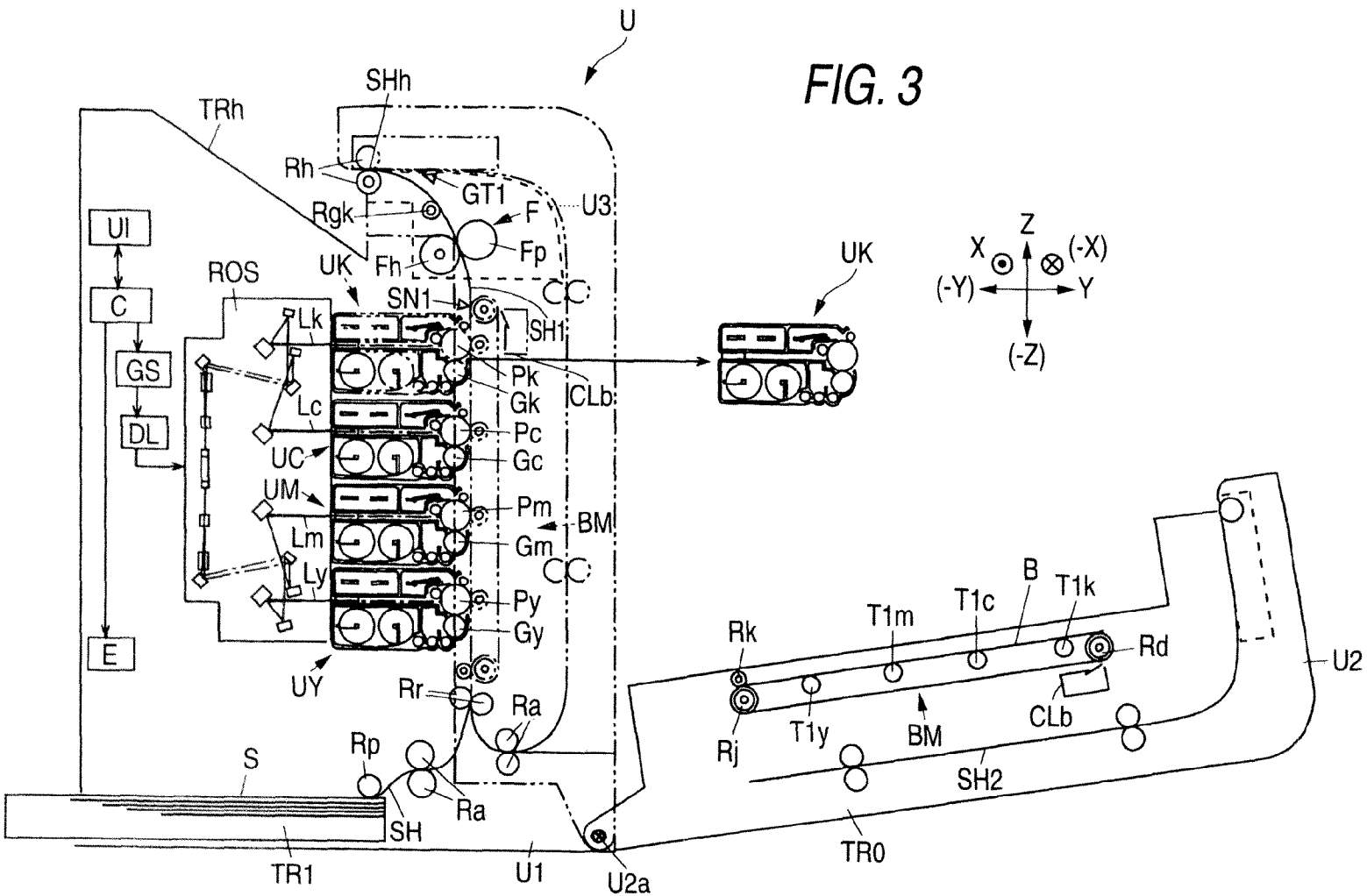
FIG. 3 is a diagram explaining a state in which an opening/closing section of the image forming apparatus in accordance with the first embodiment of the invention is open.

FIG. 3 is a diagram explaining a state in which the opening/closing section of the image forming apparatus in accordance with the first embodiment of the invention is open.

In FIGS. 2 and 3, the opening/closing section U2 is configured to be movable between, on the one hand, an open position shown in FIG. 3 for exposing the interior of the image forming apparatus body U1 to replenish a developer, replace a defective member, and remove a jammed recording medium S and, on the other hand, a closed position shown in FIG. 2, which state is maintained at normal times when the image forming operation is executed.

In FIGS. 2 and 3, an operating section UI is provided on top of the printer U. The printer U is comprised of, among others, a control section C for effecting various control of the printer U; an image processing section GS whose operation is controlled by the control section C; an image writing device drive circuit DL; and a power supply unit E. The power supply unit E applies voltages to such as charging rollers CRy to CRk as exemplary chargers, developing rollers G1*y* to G1*k* as exemplary developer holding bodies, and transfer rollers T1*y* to T1*k* as exemplary transfer units (these components will be described later).

The image processing section GS converts print information which is inputted from an external image information transmitting apparatus or the like into pieces of latent image forming image information corresponding to images of four colors of K (black), Y (yellow), M (magenta), and C (cyan), and outputs the pieces of image information to the image writing device drive circuit DL at predetermined timings. The image writing device drive circuit DL outputs drive signals to a latent image writing device ROS according to the received pieces of image information of the respective colors. According to the drive signals, the latent image writing device ROS emits laser beams Ly, Lm, Lc, and Lk as exemplary image writing light beams of the respective colors.

In FIG. 3, visible image forming devices UY, UM, UC, and UK for forming toner images as exemplary visible images of the respective colors of Y, M, C, and K are disposed on the right side (+Y direction) of the latent image writing device ROS.

Figure 4:
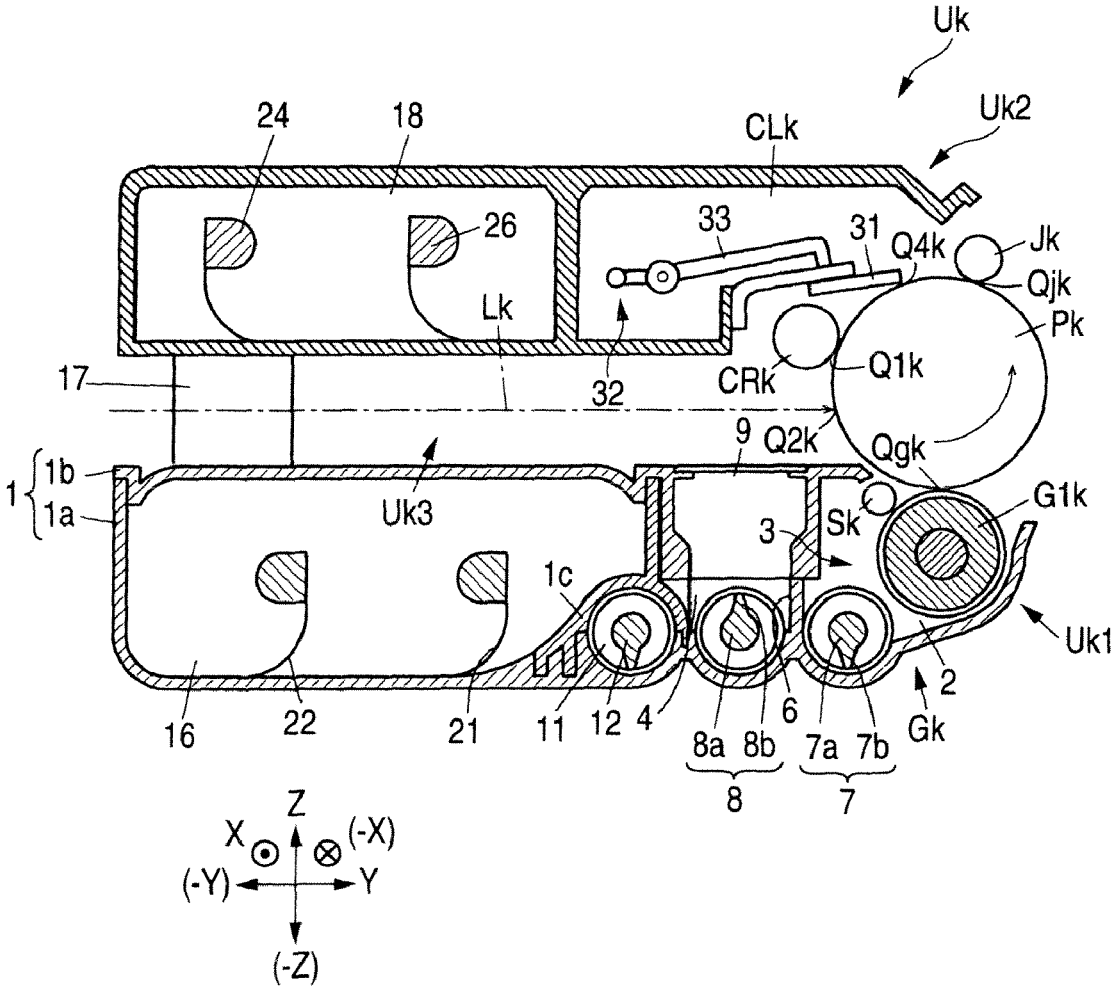
FIG. 4 is an explanatory diagram of a visible image forming device as an exemplary detachable body in accordance with the first embodiment of the invention.

FIG. 4 is an explanatory diagram of a visible image forming device as an exemplary detachable body in accordance with the first embodiment of the invention.

In FIG. 4, the visible image forming device UK of K (black) has a photoconductor Pk as an exemplary rotary image holding body. The charging roll CRk as an exemplary charger, a developing device Gk for developing a latent image on the surface of the photoconductor Pk into a visible image, a discharging member Jk for removing charge from the surface of the photoconductor Pk, a photoconductor cleaner CLk as an exemplary image holding body cleaner for removing developer remaining on the surface of the photoconductor Pk, and the like are disposed around the photoconductor Pk.

After the surface of the photoconductor Pk is charged up uniformly as a result of charging by the charging roll CRk in a charging region Q1*k* which is opposed to the charging roll CRk, a latent image is written to the photoconductor Pk in a latent image forming region Q2*k* with a laser beam Lk. The thus-written latent image is formed into a visible image in a development region Qgk which is opposed to the developing device Gk.

The visible image forming device UK of black in accordance with the first embodiment is a detachable body, i.e., a so-called process cartridge, in which the photoconductor Pk, the charger CRk, the developing device Gk, the discharging member Jk, the photoconductor cleaner CLk, a developer replenishment container (11+16+18), and the like are formed integrally. As shown in FIG. 3, the visible image forming device UK is configured detachably with respect to the image forming apparatus body U1 in a state in which the opening/closing section U2 is moved to the open position.

The visible image forming devices UY, UM, and UC of the other colors are configured in the same manner as the visible image forming device UK of black, and are also constituted by detachable bodies, i.e., the so-called process cartridges, UY, UM, and UC which are detachable with respect to the image forming apparatus body U1.

In FIGS. 2 and 3, a belt module BM as an exemplary recording medium transport device supported by the opening/closing section U2 is disposed on the right side of the photoconductors Py to Pk. The belt module BM has a medium transport belt B as an exemplary endless belt and an exemplary recording medium holding transport member; a belt drive roll Rd as an exemplary drive member for supporting the medium transport belt B; belt support rolls (Rd+Rj) as an exemplary holding transport member support system including a driven roll Rj as an exemplary driven member; the transfer rolls T1*y*, T1*m*, T1*c*, and T1*k* as exemplary transfer units which are opposed to the respective photoconductors Py to Pk; an image density sensor SN1 as an exemplary image density detecting member; a belt cleaner CLb as an exemplary cooling path forming unit and an exemplary holding transport member cleaner; and a medium adsorbing roll Rk as an exemplary recording medium adsorbing member which is disposed in face-to-face relation to the driven roll Rj and adsorbs the recording medium S onto the medium transport belt B.

The medium transport belt B is rotatably supported by the belt support rolls (Rd+Rj). The image density sensor SN1 detects, at a predetermined timing, the density of a density detecting image, i.e., a so-called patch image, which is formed by an image density adjusting unit (not shown) of the control section C. The image density adjusting unit performs image density adjustment or correction, i.e., so-called process control, by adjusting the voltages applied to the chargers CRy to CRk, the developing devices Gy to Gk, and the transfer rolls T1*y* to T1*k* and by adjusting the intensities of the latent image writing light beams Ly to Lk on the basis of the image density detected by the image density detecting member.

The recording sheet S is taken out by a sheet feed member Rp from the sheet feed tray TR1 which is location below the medium transport belt B, and is transported to a recording medium transport path SH.

In the recording medium transport path SH, the recording medium S is transported by medium transport rolls Ra as exemplary recording medium transport members and is thereby sent to registration rolls Rr as exemplary sheet feed timing adjusting members. The registration rolls Rr transport, at a predetermined timing, the recording medium S to a recording medium adsorbing position (region) Q6 where the driven roll Rj and the medium adsorbing roll Rk are opposed to each other. The recording medium S which has been transported to the recording medium adsorbing position Q6 is electrostatically adsorbed onto the medium transport belt B.

In the case where the recording medium S is fed from a manual feed unit TRO, the recording medium S fed through manual feed members Rp1 is transported to the registration rolls Rr by the medium transport rolls Ra and is then transported to the medium transport belt B.

In FIGS. 2 to 4, the recording medium S which is adsorbed on the medium transport belt B sequentially passes transfer regions Q3*y*, Q3*m*, Q3*c*, and Q3*k* where the medium transport belt B is brought into contact with the photoconductors Py to Pk, respectively.

At each of the transfer regions Q3*y*, Q3*m*, Q3*c*, and Q3*k*, a transfer voltage whose polarity is opposite to the toner charging polarity is applied, at a predetermined timing, to the transfer roll T1*y*, T1*m*, T1*c*, or T1*k* from the power supply unit E which is controlled by the control section C.

In the case of forming a multi-color image, toner images on the respective photoconductors Py to Pk are transferred in superimposition onto the recording medium S on the medium transport belt B by the transfer rolls T1*y*, T1*m*, T1*c*, and T1*k*. In the case of forming a single-color image, i.e., a so-called monochrome image, only a toner image of K (black) is formed on the photoconductor Pk, and only the toner image of K (black) is transferred onto the recording medium S by the transfer unit T1*k*.

In FIG. 4, after charges are removed from the surfaces of the photoconductors Py to Pk by discharging members Jy to Jk in discharging regions Qjy to Qjk, toner remaining on the surfaces of the photoconductors Py to Pk is collected by the photoconductor cleaners CLy to CLk in cleaning regions Q4*y* to Q4*k* to clean the surfaces. Then, the surfaces of the photoconductors Py to Pk are charged up again by the charging rolls CRy to CRk.

The recording medium S to which the toner images have been transferred are subjected to fixing in a fixing region Q5 where a heating roll Fh as an exemplary heating fixing member of a fixing device F and a pressure roll Fp as an exemplary pressurizing fixing member thereof are brought into pressure contact with each other. The recording medium S on which the image has been fixed is guided by a guide roller Rgk as an exemplary guide member and is discharged to the medium discharging unit TRh from sheet discharge rollers Rh as exemplary medium discharging members.

After separation of the recording medium S, the medium transport belt B is cleaned by the belt cleaner CLb.

In the case of double-sided printing, the discharge rollers Rh are driven so as to be rotated reversely, and the recording medium S is transported to a medium inversion path SH2 as an exemplary medium transport path by means of a switching member GT1. The recording medium S is sent again to the registration rolls Rr again in a state in which the obverse and reverse sides are inverted.

In the first embodiment, the fixing device F, the lower drive roller of the sheet discharge rollers Rh, the switching member GT1, and the lower guide surface of the medium inversion path SH2 constitute an integrated, replaceable fixing device, i.e., a so-called fixing unit, U3. In addition, the upper driven member of the sheet discharge rollers Rh is supported by the opening/closing section U2.

(Visible Image Forming Device)

Hereafter, a detailed description will be given of the visible image forming devices UY to UK. Since the visible image forming devices UY to UK of the respective colors are configured in the same manner, only the visible image forming device UK of black will be described, and the description of the other visible image forming devices UY, UM, and UC will be omitted.

In FIG. 4, the visible image forming device UK is configured in such a manner that a developing unit Uk1 having the photoconductor Pk and the developing device Gk and a cleaning and charging unit Uk2 having the charging roll CRk, the photoconductor cleaner CLk, and the discharging roll Jk are assembled. A writing light passage Uk3 through which the laser beam Lk passes is formed between the developing unit Uk1 and the cleaning and charging unit Uk2.

The developing unit Uk1 has a developer container 1 in which a developer is accommodated. The developer container 1 has a lower developer container body 1*a*, a lid member 1*b* which closes the developer container body 1*a* from above, and a central partition member 1*c* which forms a developer transport chamber (described later) by partitioning the developer container body 1*a* at a central position an the right-left direction.

The developer container 1 has a developer holding body accommodating chamber 2 which supports the developing roll G1*k* as an exemplary developer holding body which is opposed to the photoconductor Pk, a first agitation transport chamber 3 which is adjacent to the developer holding body accommodating chamber 2 from the left side and in which the developer is accommodated, and a second agitation transport chamber 4 which is adjacent to the first agitation transport chamber 3 from the left side. A layer thickness restricting member Sk for restricting the layer thickness (i.e., the thickness of the developer carried by the surface of the developing roll G1*k*) is disposed in the developer holding body accommodating chamber 2 so as to be opposed to the developing roll G1*k*.

The first agitation transport chamber 3 and the second agitation transport chamber 4 as exemplary developer accommodating chambers are separated from each other by a partition wall 6. The first agitation transport chamber 3 and the second agitation transport chamber 4 are configured so that the developer can move between them at both ends in the front-rear direction.

A two-component developer including a toner and a carrier is accommodated as the developer in the developer container 1 in accordance with the first embodiment. In addition, a circulation transport chamber (3+4) is formed by the first agitation transport chamber 3 and the second agitation transport chamber 4, and the developer holding body accommodating chamber 2 and the circulation transport chamber (3+4) constitute the developer accommodating chamber (2 to 4).

Agitation transfer members 7 and 8 as exemplary developer transport members for transporting the developer in mutually opposite directions while agitating it are disposed in the first agitation transport chamber 3 and the second agitation transport chamber 4, respectively. The agitation transport members 7 and 8 in accordance with the first embodiment are constituted by so-called augers, i.e., agitation transport members having rotary shafts 7*a* and 8*a* and spiral transport blades 7*b* and 8*b* which are fixedly supported by the rotary shafts 7*a* and 8*a*, respectively. The pair of agitation transport members 7 and 8 constitute the circulation transport member (7+8) in accordance with the first embodiment.

In FIG. 4, the lid member 1*b* is formed with an initial developer accommodating chamber 9 which is located over the second agitation transport chamber 4.

A cylindrical toner transport chamber 11 as an exemplary developer transport chamber is formed on the left side of the second agitation transport chamber 4. The toner transport chamber 11 is connected to the second agitation chamber 4, and a developer replenishment member 12 as an exemplary developer replenishment member for transporting the developer in the toner transport chamber 11 into the second agitation transport chamber 4 is disposed in the toner transport chamber 11.

A first toner replenishment chamber 16 as an exemplary first developer replenishment chamber is formed on the left side of the toner transport chamber 11, and a second toner replenishment chamber 18 as an exemplary second developer replenishment chamber, which is connected to the first toner replenishment chamber 16 via toner drop passages 17 formed at both ends in the front-rear direction, is disposed over the first toner replenishment chamber 16. A first developer transport member 21 and a second developer transport member 22 both as exemplary developer replenishment members for transporting the toner in the first toner replenishment chamber 16 into the toner transport chamber 11 are disposed in the first toner replenishment chamber 16.

The second toner transport member 22 transports the toner toward the first toner transport member 21. A third toner transport member 24 and a fourth toner transport member 26 both as exemplary developer replenishment members which are disposed in the second toner replenishment chamber 18 transport the toner in the second toner replenishment chamber 18 toward the toner drop passages 17.

The toner transport chamber 11, the first toner replenishment chamber 16, and the second toner replenishment chamber 18 constitute a toner replenishment container (11+16+18) as an exemplary developer replenishment container in accordance with the first embodiment, and the toner replenishment member as an exemplary developer replenishment member is constituted by the members denoted by the reference numerals 12, 21, 22, 24, and 26.

The photoconductor cleaner CLk is disposed on the right side of the second toner replenishment chamber 18. In addition, the photoconductor cleaner CLk has a plate-like image holding body cleaning member or a so-called cleaning blade 31 which is in contact with the surface of the photoconductor Pk, as well as a collected toner transport member 33 as an exemplary collected developer transport member for allowing the toner, paper dust, electric discharge products, and the like which have been scraped off by the cleaning blade 31 to be transported to a collected toner accommodating chamber 32 as an exemplary collected developer accommodating chamber.

In FIG. 1, the opening/closing section U2 has an opening/closing section cover 40 as an exemplary exterior member of the outer surface. The opening/closing section cover 40 has a cover right side plate 40*a* on the right side surface. In addition, the opening/closing section cover 40 has a pair of cover front side plate 40*c* and a cover rear side plate 40*d* which are formed at both ends in the front-rear direction of the cover right side plate 40*a*, and has an upper side plate 40*e* at an upper end in the vertical direction. The cover right side plate 40*a* has a sheet feeding port 40*i* of the manual feed unit TRO formed in its lower portion.

(Medium Transport Belt Cooling Structure)

Figure 5:
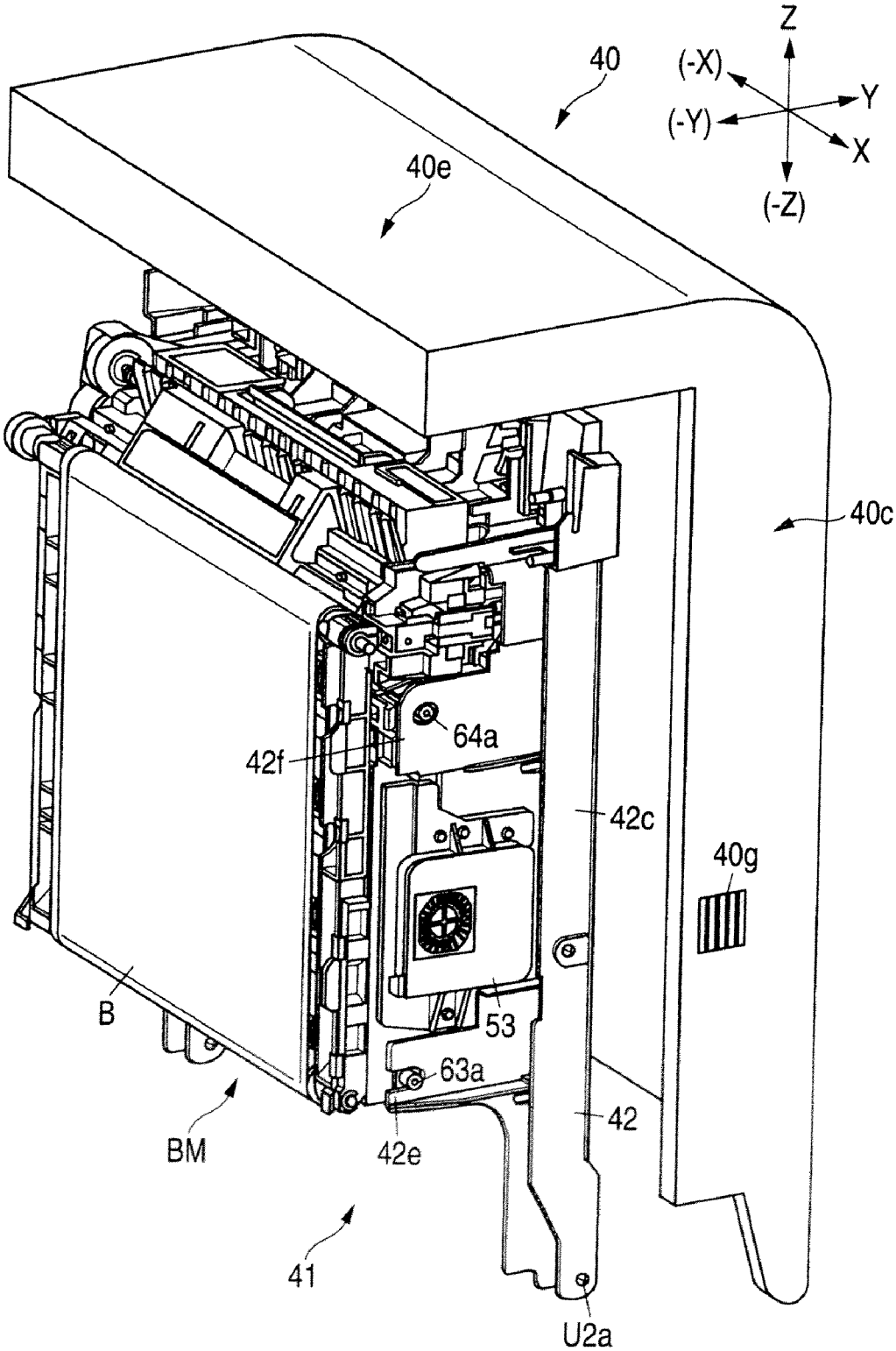
FIG. 5 is an explanatory perspective view of a unit which is supported inside an opening/closing section in accordance with the first embodiment of the invention.

FIG. 5 is an explanatory perspective view of the unit which is supported inside the opening/closing section in accordance with the first embodiment of the invention.

Figure 6:
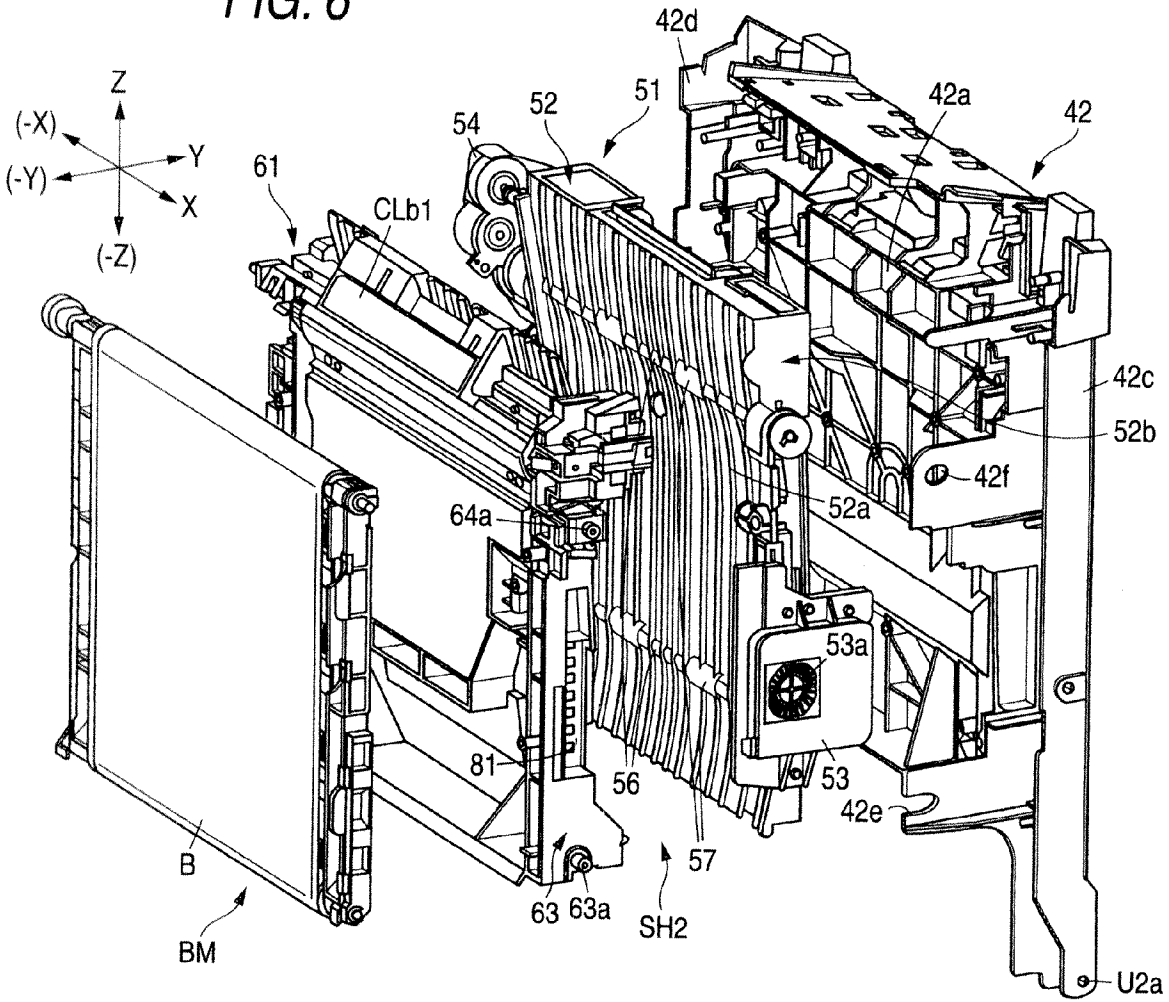
FIG. 6 is an explanatory exploded view of the unit which is supported inside the opening/closing section in accordance with the first embodiment of the invention.

FIG. 6 is an explanatory exploded view of the unit which is supported inside the opening/closing section in accordance with the first embodiment of the invention.

In FIGS. 5 and 6, a recording medium transport device 41 as an exemplary endless member driving device is supported on the inner side of the opening/closing section cover 40. In FIG. 5, the recording medium transport device 41 has an opening/closing frame 42 as an exemplary opening/closing frame body. The opening/closing frame 42 has a right side wall 42*a* and a pair of a front side wall 42*c* and a rear side wall 42*d* formed at both ends in the front-rear direction of the right side wall 42*a*. The rotating shaft U2*a* which is supported rotatably by the image forming apparatus body U1 is formed in a lower end portion of the front side wall 42*c* and the rear side wall 42*d*. U-shaped cleaner unit lower side supporting portions 42*e* whose left sides are open are respectively formed in central lower portions of the front side wall 42*c* and the rear side wall 42*d*. Cleaner unit upper side supporting portions 42*f* are respectively formed in the front side wall 42*c* and the rear side wall 42*d* above the cleaner unit lower side supporting portions 42*e*.

Figure 7A:
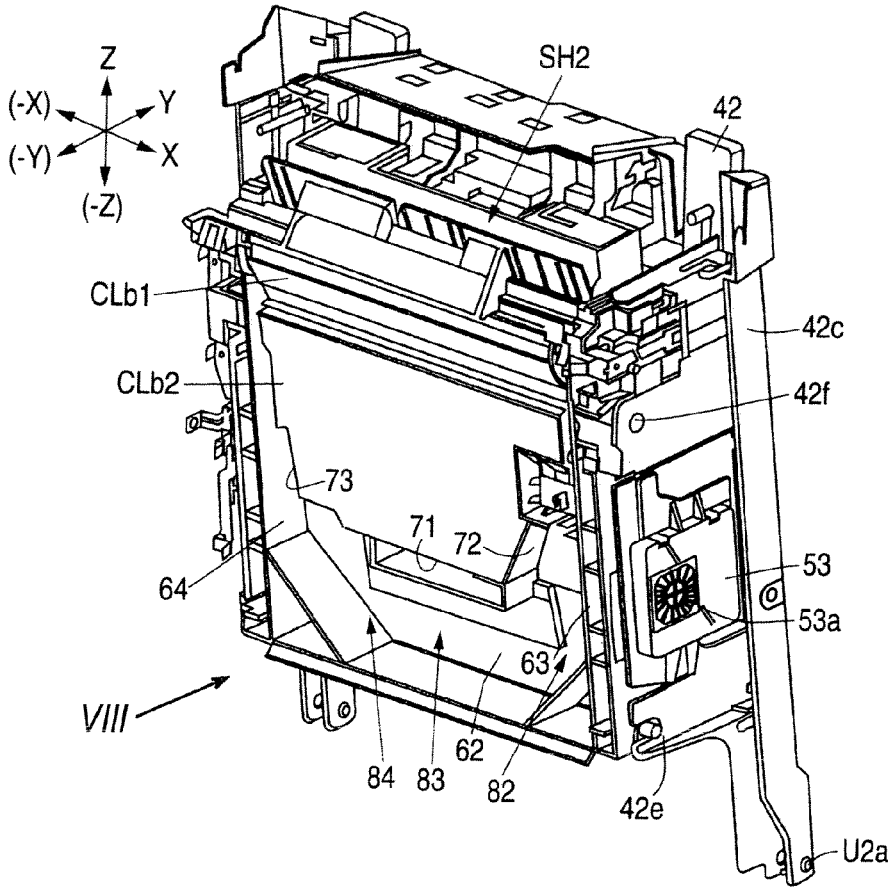
Figure 7B:
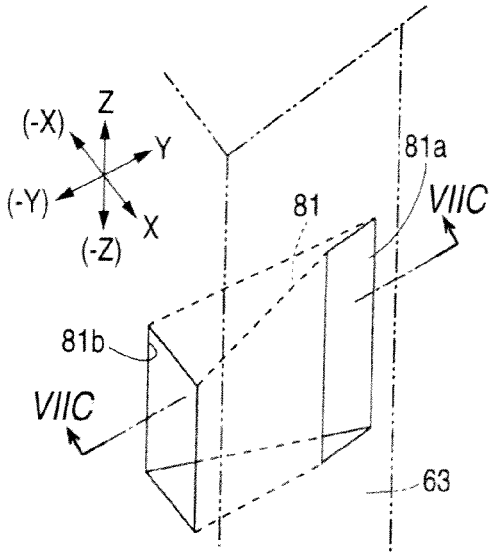
Figure 7C:
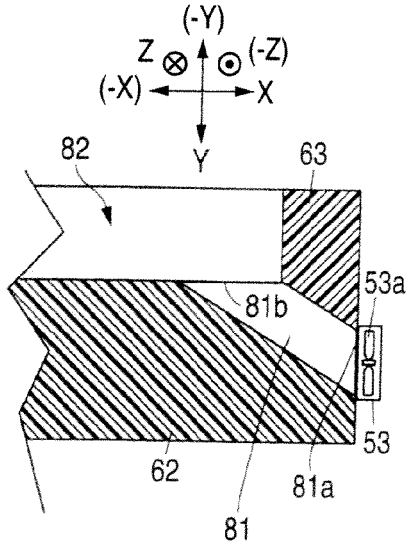

FIGS. 7A to 7C are diagrams explaining a state in which the belt module is removed from the unit supported inside the opening/closing section in accordance with the first embodiment of the invention. FIG. 7A is an explanatory perspective view, FIG. 7B is an enlarged explanatory view of an essential portion of a suction path portion, and FIG. 7C is a cross-sectional view taken along line VIIC-VIIC in FIG. 7B.

Figure 8:
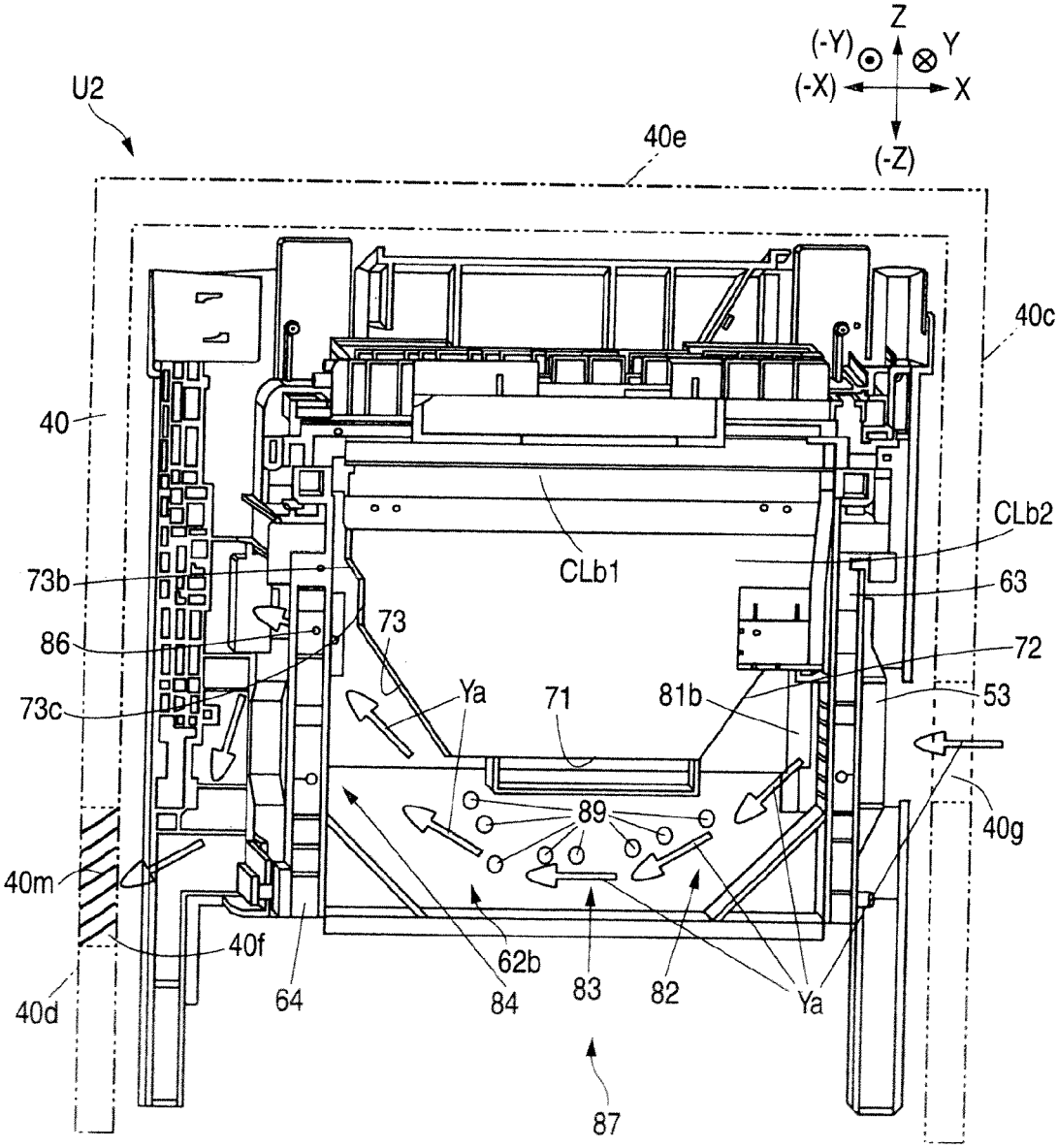
FIG. 8 is a view taken from the direction of arrow VIII in FIG. 7A.

FIG. 8 is a view taken from the direction of arrow VIII in FIG. 7A.

Figure 9:
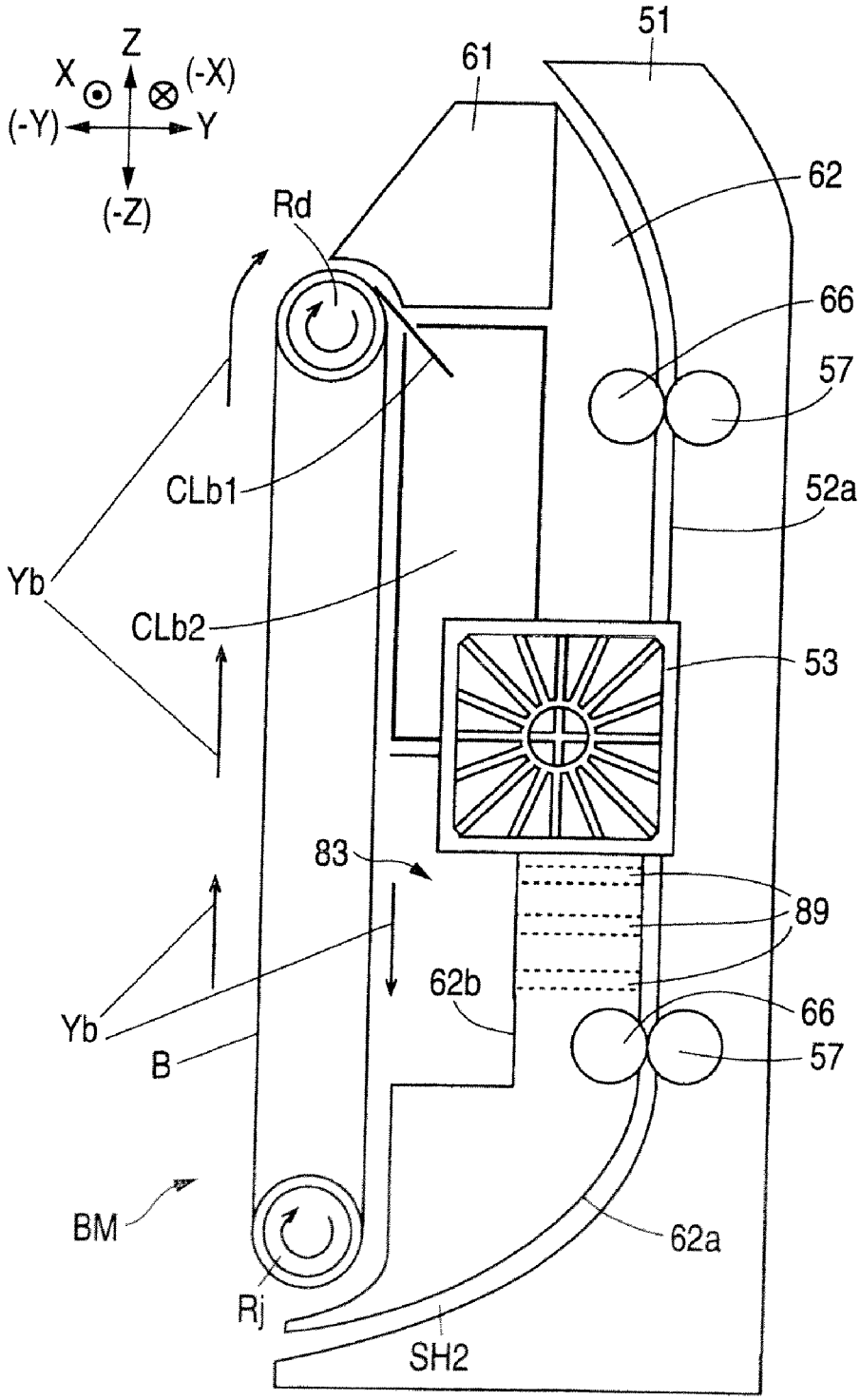
FIG. 9 is a side view of the unit supported in the interior of the opening/closing section in accordance with the first embodiment of the invention.

FIG. 9 is a side view of the unit supported in the interior of the opening/closing section in accordance with the first embodiment of the invention.

In FIGS. 6 to 9, a drive-side inversion unit 51 is supported on the inner side of the opening/closing frame 42. The drive-side inversion unit 51 has a plate-like drive-side unit body 52 extending in the vertical direction. An outer guide surface 52*a* of the medium inversion path SH2 is formed on a left side surface of the drive-side unit body 52. A cooling fan 53, which serves as an exemplary gas transfer unit and as an exemplary cooling member and is composed of a plurality of cooling blades 53*a* as exemplary blower blades, is supported on a lower portion of a front side surface 52*b* in the drive-side unit body 52.

An inverting motor unit 54 as an exemplary inversion path driving source is supported on an upper end portion of a rear side surface of the drive-side unit body 52. A plurality of inverting drive shafts 56 extending in the front-rear direction are disposed on the outer guide surface 52*a* at predetermined intervals provided in the vertical direction. Two inversion drive rollers 57 as exemplary inverting drive members are supported on the inverting drive shaft 56 at a predetermined interval provided in the front-rear direction. Drive is transmitted to the inverting drive shafts 56 from the inverting motor unit 54 to rotatively drive the inversion drive rollers 57.

In FIGS. 6 and 9, a cleaner unit 61 as an exemplary transfer transport member cleaning unit is disposed on the left side of the drive-side inversion unit 51. The cleaner unit 61 has a plate-like inner guide member 62 extending vertically and disposed in face-to-face relation to the outer guide surface 52*a* as well as a front side plate 63 and a rear side plate 64 which are supported at both front and rear ends of the inner guide member 62. An inner guide surface 62*a* is formed on the right side of the inner guide member 62, and the aforementioned medium inversion path SH2 is formed by a space between the inner guide surface 62*a* and the outer guide surface 52*a*.

An unillustrated driven shaft and an inverting driven roller 66 as an exemplary inverting driven member supported by the driven shaft are disposed on the inner guide surface 62*a* in correspondence with the inverting drive shaft 56 and the inverting driving roller 57, respectively.

A cleaner unit lower supported portion 63*a* and a cleaner unit upper supported portion 64*a* which project outward are formed on the front side plate 63 and the rear side plate 64 in correspondence with the cleaner unit lower supporting portion 42*e* and the cleaner unit upper supporting portion 42*f* of the opening/closing frame 42. Accordingly, the cleaner unit 61 is detachably supported by the opening/closing frame 42 as the cleaner unit lower supported portion 63*a* and the cleaner unit upper supported portion 64*a* are respectively supported by the cleaner unit lower supporting portion 42*e* and the cleaner unit upper supporting portion 42*f*. The belt cleaner CLb is supported on upper portions of inner walls of the inner guide member 62, the front side plate 63, and the rear side plate 64.

The belt cleaner CLb has a cleaning blade CLb1 and a collection container CLb2 for collecting and accommodating the residue removed by the cleaning blade CLb1. In FIGS. 7A and 8, the collection container CLb2 includes a bottom plate 71 along the front-rear direction, a front-side inclined wall 72 which is inclined diagonally forwardly upward from a front end of the bottom plate 71, and a rear-side inclined wall 73 which is inclined diagonally backward and upward from a rear end of the bottom plate 71. A vertical wall 73*c* extending vertically and an upper inclined wall 73*b* extending backwardly upward are formed at an upper end of the rear-side inclined wall 73. Accordingly, the residue removed by the cleaning blade CLb1 is configured to be guided by inner surfaces of the front-side inclined wall 72 and the rear-side inclined wall 73 and drop onto and accumulate on the bottom plate 71.

(Duct)

Figures 10A, 10B:
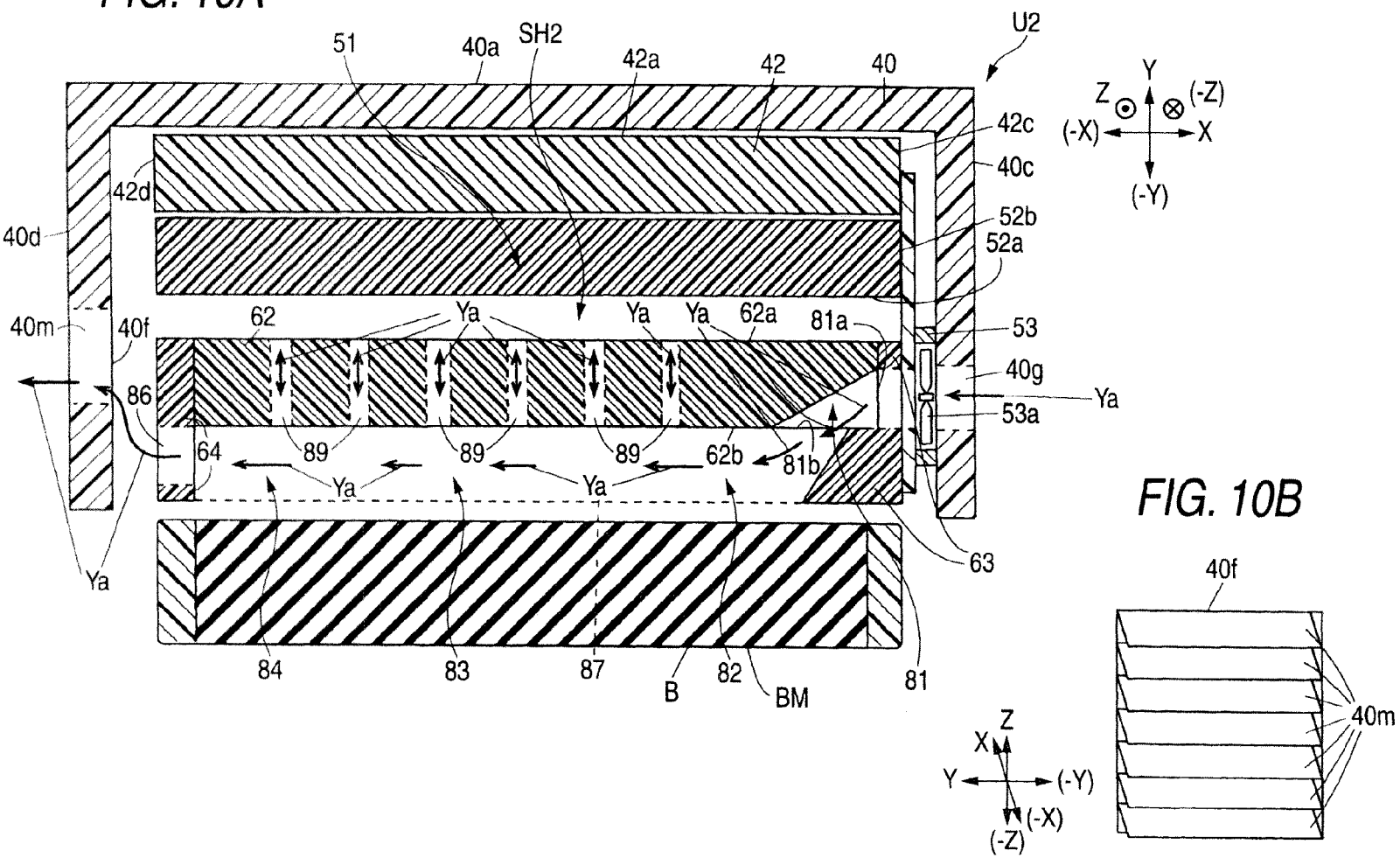
FIG. 10A is an explanatory view of an essential portion, taken from the upper side, of the flow of air in accordance with the first embodiment of the invention.
FIG. 10B is a diagram explaining the structure of an exhaust port formed in a opening/closing section cover.

FIG. 10A is an explanatory view, taken from the upper side, of the flow of air in accordance with the first embodiment of the invention. FIG. 10A is an explanatory diagram of an essential portion, and FIG. 10B is a diagram explaining the structure of an exhaust port formed in the opening/closing section cover.

In FIG. 8, a cover suction port 40*g* is formed in the cover front side plate 40*c* at a position opposing the cooling fan 53. In FIGS. 7B, 7C, and 10A, a suction path 81, which is inclined backward and downward from a front side end of the front side plate 63 toward the left side, is formed in a front end portion of the inner guide member 62 and the front side plate 63. The suction path 81 has a suction port 81*a* as an exemplary inlet port formed so as to be open in a front end surface of the front side plate 63 as well as an outlet port 81*b* formed so as to be open in a left side surface of the inner guide member 62. Accordingly, air as an exemplary gas sucked from the cooling fan 53 is sucked from the suction port 81*a*, passes through the suction path 81, and flows out from the outlet port 81*b*.

In FIG. 8, the cleaner unit 61 has formed therein an upstream-side inclined path 82 which is inclined downward toward the rear along the front-side inclined wall 72, and the outlet port 91*b* is formed at an upstream end in the direction of the gas flow of the upstream-side inclined path 82. A main ventilation path 83 extending in the right-left direction along the bottom plate 71 is formed at a lower end of the upstream-side inclined path 82. An exhaust path 84 as an exemplary downstream-side inclined path which is inclined diagonally upward along the rear-side inclined wall 73 is formed at a rear end of the main ventilation path 83. The air in the exhaust path 84 is exhausted from an exhaust port 86 as an exemplary cooling exhaust port formed in a vertically central portion of the rear side plate 64. In FIGS. 1, 8, and 10A, a cover exhaust port 40*f* as an exemplary exterior exhaust port through which the gas from the exhaust path 84 is exhausted to the outside is formed in a vertically lower portion of the rear side plate 40*d*. The cover exhaust port 40*f* is disposed at a position out of alignment both in the vertical direction and in the right-left direction with respect to the exhaust port 86. Louvers 40*m*, which serve as exemplary light shielding members composed of a plurality of inclined plates and inclined downward from an inner surface side of the rear side plate 40*d* toward the outer surface side, are fitted at the cover exhaust port 40*f*. Accordingly, in the cleaner unit 61 in accordance with the first embodiment of the invention, a duct 87 as an exemplary cooling path of a substantially U-shape formed along a lower surface of the collection container CLb2 is constituted by the upstream-side inclined path 82, the main ventilation path 83, and the exhaust path 84.

In FIG. 9, the inner guide member 62 has a duct-side surface 62*b* at a position corresponding to the duct 87, and a plurality of through holes 89 as exemplary gas flowout paths for allowing the duct side surface 62*b* and the guide surface 62*a* to communicate with each other are formed at a position corresponding to the main ventilation path 83 of the duct side surface 62*b*. The belt module BM side of the duct 87 is open and is disposed in a state in which the outer surface of the medium transport belt B is exposed to the duct 87.

(Operation of the First Embodiment)

In the printer U as an exemplary image forming apparatus in accordance with the first embodiment having the above-described constituent requirements, air outside the opening/closing section cover 40 is sucked from the cover suction port 40*g* by the rotational operation of the cooling fan 53. The air sucked from the cover suction port 40*g* passes through the cooling fan 53 and then flows into the suction port 81*a*. The air which flowed in from the suction port 81*a* flows out into the duct 87. At this time, the suction path 81 of a right portion of the duct 87 is inclined along the flow of air which advances spirally and is produced by the rotation of the cooling fan 53. Accordingly, it is possible to reduce a decrease of the amount of air flowing into the upstream-side inclined path 82 in accordance with the first embodiment as compared with a case where a suction path extending in the axial direction of the cooling fan 53 is provided or a case where an exhaust path is provided which is inclined so as to hamper the spiral flow of air.

The air in the duct 87 flows through the duct 87 along the outer surface of the medium transport belt B, and the medium transport belt B is cooled by the air flowing in the direction of arrow Ya shown in FIGS. 8 and 10A. Accordingly, it is possible to suppress the temperature rise of the medium transport unit B due to the image forming operation or the like, with the result that it is possible to decrease the temperature rise of the interior of the printer U and reduce the deterioration, coagulation, solidification, and the deterioration of fluidity of the developer.

Figure 11:
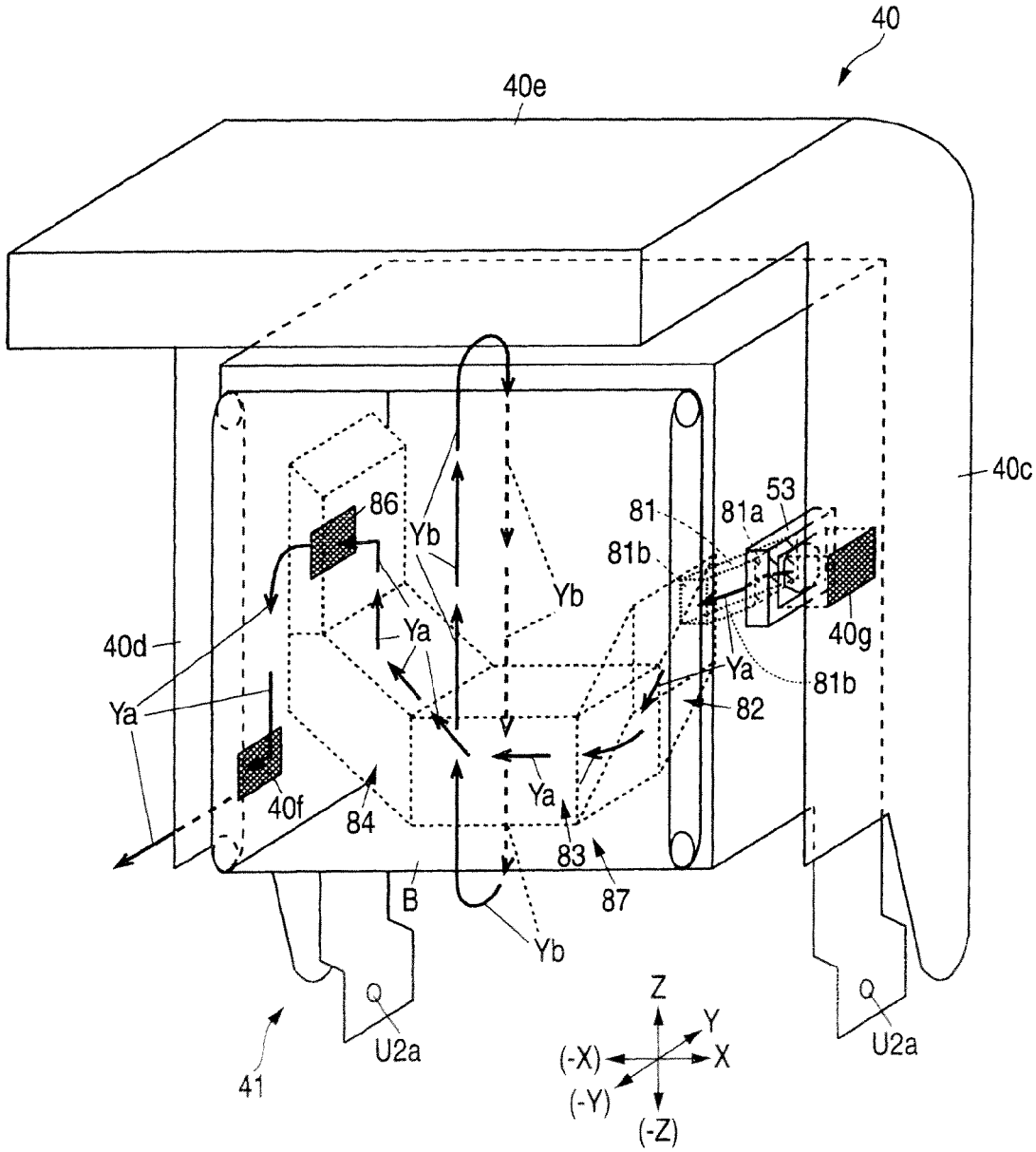
FIG. 11 is an explanatory diagram of an essential portion in which the flow of air in accordance with the first embodiment of the invention is viewed from a diagonal direction.

FIG. 11 is an explanatory diagram of an essential portion in which the flow of air in accordance with the first embodiment of the invention is viewed from a diagonal direction.

In FIGS. 8 to 11, the air flowing through the duct 87 flows diagonally downward through the upstream-side inclined path 82, as indicated by arrow Ya, flows in the horizontal direction through the main ventilation path 83, and flows diagonally upward through the exhaust path 84. Meanwhile, as for the medium transport belt B, the surface exposed to the duct 87 moves in the downward direction. Accordingly, the relative velocity between the air flowing through the upstream-side inclined path 82 and the medium transport belt B rotating in the direction of arrow Yb shown in FIGS. 9 and 11 is small, whereas the relative velocity between the air flowing through the exhaust path 84 and the medium transport belt B is large. In consequence, the cooling effect of the air flowing through the exhaust path 84 with the large relative velocity is greater than the cooling effect of the air flowing through the upstream-side inclined path 82 with the small relative velocity. Hence, the front side of the medium transport belt B exposed to the upstream-side inclined path 82 is cooled by the relatively cool air which flowed in from the outside, while the rear side of the medium transport belt B exposed to the exhaust path 84 having the high cooling effect is cooled by the air which has become relatively warm by absorbing the heat from the medium transport belt B in the upstream-side inclined path 82 and the main ventilation path 83. Therefore, the cooling effect is enhanced as compared with the conventional techniques. In addition, cooling is effected efficiently and uniformly in the front-rear direction of the medium transport belt B, so that it is possible to suppress the variation of the temperature distribution on the medium transport belt B. It should be noted that an excessive temperature rise of air due to the excessive cooling of the medium transport belt B is suppressed while obtaining the effect of cooling the medium transport belt B by making the relative velocity small by allowing the relatively cool air flowing in from the outside to flow so as to be directed toward the direction of rotation of the medium transport belt B. However, to suppress the variation of the temperature distribution, the upstream-side inclined path 82 may be set horizontally in the same way as the main ventilation path 83. Furthermore, the lengths and angles of the upstream-side inclined path 82, the main ventilation path 83, and the exhaust path 84 may be altered, as required.

The duct 87 and the medium inversion path SH2 are configured such that air can flow into the medium inversion path SH2 from the duct 87 by means of the through holes 89. Accordingly, the medium inversion math SH2 and the recording medium S which is transported along the medium inversion path SH2 are cooled by the air which flows into the medium inversion path SH2. Hence, after passing the fixing device F during double-sided printing, the warm recording medium S being transported along the medium inversion path SH2 and the medium inversion path SH2 warmed by the recording medium S are cooled. Therefore, the temperature rise of the medium transport belt B can be suppressed as compared with the case where the warm recording medium S is retransported by the medium transport belt B.

The louvers 40*m* are fitted to the cover exhaust port 40*f* in accordance with the first embodiment. Hence, the outside light which is the light radiated from outside the printer U is shielded by the louvers 40*m*, so that the amount of outside light passing through the cover exhaust port 40*f* and entering the interior is reduced. In addition, the position where the cover exhaust port 40*f* is disposed relative to the exhaust port 86 is out of alignment both in the vertical direction and in the right-left direction. For this reason, it is possible to reduce the amount of outside light reaching the interior of the printer U through the duct 87 after entering through the louver exhaust port 40*f*. Therefore, it is possible to suppress the optical deterioration of the respective members disposed inside the printer U due to the outside light and a decline in the image quality in the recording medium S due to the application of the outside light to the photoconductor surface.

In particular, in the invention, the photoconductors Py to Pk are disposed in contact with the medium transport belt B, and in the case where the outside light has entered through the cover exhaust port 40*f* provided at a position close to the medium transport belt B, there is a high possibility that the photoconductors unfavorably become exposed to light. Hence, as the cover exhaust port 40*f* is disposed at a position out of alignment with the exhaust port 86 both in the vertical direction and in the right-left direction, and the louvers 40*m* are attached, the possibility of exposure of the photoconductors Py to Pk is reduced.

As for the exhaust path 84, the rear-side inclined wall 73 and the upper side and the upper inclined wall 73*b* are formed in such a manner as to be inclined upward, so that air is made difficult to stagnate as compared with the case where steps in staircase form are formed. Accordingly, a decline in the cooling efficiency is avoided. In addition, the residue collected on the rear end side by the cleaning blade CLb1 of the collection container CLb2 is made to drop down along the inner surfaces of the upper inclined wall 73*b* and the rear-side inclined wall 73 and is transported, so that the possibility of the residue overflowing at the rear end portion is reduced.

(Modifications)

Although a detailed description has been given above of the embodiment of the invention, the invention is not limited to the foregoing embodiment, and various modifications may be made without departing from the spirit of the invention defined in the appended claims. Modifications (H01) to (H07) of the invention are shown below by way of example.

(H01) Although in the foregoing embodiment a printer as the image forming apparatus has been illustrated by way of example, the invention is not limited to the same and may also be applied to a facsimile machine, a copying machine, or a combination machine equipped with all of these or a plurality of functions. In addition, the invention is not limited to a color image forming apparatus, and the image forming apparatus may be constituted by a monochromatic image forming apparatus. Further, the invention is not limited to a so-called tandem type image forming apparatus and may also be applied to a rotary or other type of image forming apparatus. Furthermore, as the tandem type image forming apparatus, the invention is also applicable to an apparatus of a form in which a sheet is placed on a medium transport belt, and visible images of a plurality of colors are directly superimposed sequentially on the sheet, or to an apparatus of a form in which after visible images of a plurality of colors are directly superimposed sequentially on a belt, the visible images are collectively transferred onto a sheet.

Figure 12:
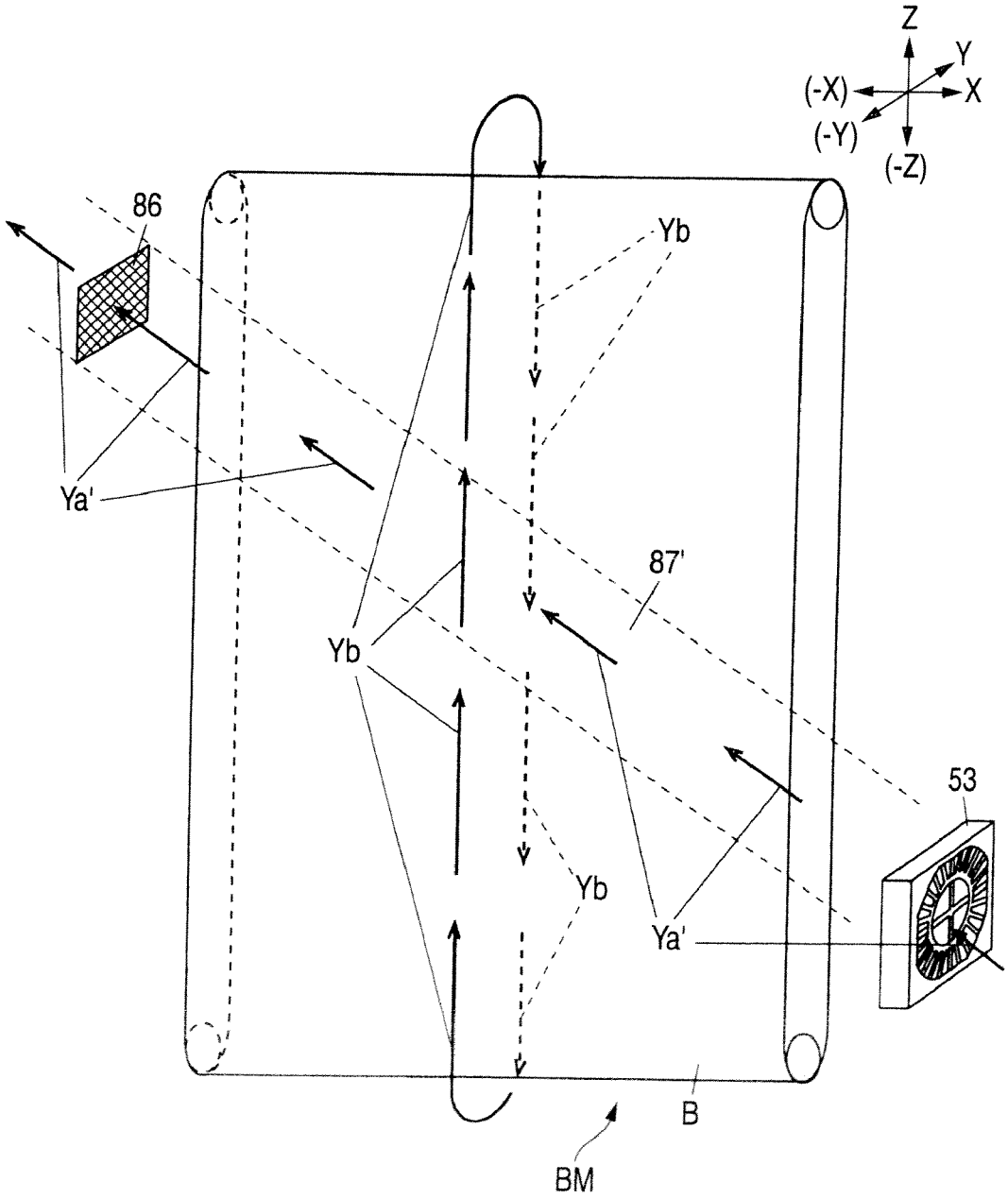
FIG. 12 is a diagram explaining the shape of a cooling path in accordance with a modification of the invention.

(H02) FIG. 12 is a diagram explaining the shape of a cooling path in accordance with a modification of the invention.

Although in the foregoing embodiment the substantially U-shaped cooling path, i.e., the so-called duct, which is formed along the lower surface of the collection container for collecting and accommodating the residue removed by the cleaning blade, has been illustrated by way of example, the cooling path is not limited to this shape, and an arbitrary shape may be adopted. For example, as shown in FIG. 12, it is possible to adopt a cooling path 87' which extends linearly diagonally upward from a front-side lower end and in which air flows in the direction of arrow Ya', in which direction the relative velocity with respect to the medium transport belt B which rotates in the direction of arrow Yb becomes large in the entire region in the widthwise direction of the medium. Still alternatively, as for the downstream side of the duct, instead of adopting the diagonally inclined shape, it is possible to adopt an arbitrary shape such as an upwardly oriented, then horizontally oriented, and then upwardly oriented stepped shape or crank shape, a meandering shape, or the like.

(H03) Although in the foregoing embodiment the cover exhaust port has been illustrated by way of example as the exterior exhaust port, the exterior exhaust port is not limited to the same, and it is also possible to make use of other exhaust port leading from the interior of the printer body to the outside. For example, warmed air can also be discharged from the sheet discharge tray located on the upper surface of the image forming apparatus body. Still alternatively, it is also possible to adopt a configuration in which a plurality of routes, such as a route for exhausting from the cover exhaust port and a route for exhausting from the sheet discharge tray, are provided.

(H04) Although in the foregoing embodiment the image forming apparatus capable of double-sided printing and having the medium inversion path has been illustrated by way of example, the invention is not limited to the image forming apparatus of this form, and is also applicable to an image forming apparatus capable of only one-sided printing with the medium inversion path omitted.

(H05) Although in the foregoing embodiment the image forming apparatus having the cooling fan at the suction port has been illustrated by way of example, the position where the fan is disposed is not limited to the same, and the fan may be disposed at an arbitrary position within the duct. For example, the fan may be disposed at the exhaust port or may be disposed midway in the duct.

(H06) Although in the foregoing embodiment the configuration has been illustrated by way of example in which the outer surface of the medium transport belt B which is cooled by the air flowing through the duct is cooled, the duct may also be disposed so as to cool the inner reverse surface.

(H07) Although in the foregoing embodiment the medium transport belt B with which the photoconductor is brought into contact has been illustrated by way of example as the endless member, the endless member is not limited to this configuration, and the invention is also applicable to such as a medium transport belt with which an intermediate transfer belt and the photoconductor are not brought into contact.

The foregoing description of the exemplary embodiments of the present invention has been provided for the purpose of illustration and description. It is not intended to be exhaustive or to limit the invention to the precise forms disclosed. Obviously, many modifications and variations will be apparent to practitioners skilled in the art. The exemplary embodiments are chosen and described in order to best explain the principles of the invention and its practical applications, thereby enabling others skilled in the art to understand the invention for various exemplary embodiments and with the various modifications as are suited to the particular use contemplated. It is intended that the scope of the invention be defined by the following claims and their equivalents.

What is claimed is:

1. An endless member driving device, comprising:

an endless member that rotates by receiving a driving force;

a cooling path that extends in a widthwise direction along at least one of an obverse surface and a reverse surface of the endless member; and a gas transfer unit that transfers a gas in the cooling path along the widthwise direction of the endless member, wherein the cooling path includes a downstream-side cooling path that is formed on a downstream side in a gas transferring direction of the cooling path, and the downstream-side cooling path being directed in an opposite direction to a moving direction of the obverse surface or the reverse surface of the endless member perpendicular to the widthwise direction with respect to the moving direction.

2. The endless member driving device according to claim 1, wherein the gas transfer unit includes blower blades disposed at an inlet port where the gas in the cooling path flows in, and the inlet port of the cooling path is formed in such a manner as to be inclined along a spiral flow of a gas generated in consequence of rotation of the blower blades of the gas transfer unit.

3. The endless member driving device according to claim 1, wherein the cooling path further includes an upstream-side cooling path that is formed on an upstream side in the gas transferring direction of the cooling path, and the upstream-side cooling path being directed in the moving direction of the obverse surface or the reverse surface of the endless member.

4. The endless member driving device according to claim 1, wherein the downstream-side cooling path includes an upper wall that is formed in such a manner as to be inclined in the opposite direction to the moving direction of the obverse surface or the reverse surface of the endless member.

5. An image forming apparatus, comprising:

the endless member driving device according to claim 1 that includes the endless member including an endless medium transport member that rotates while coming into contact with a medium on a surface of which an image is recorded; and a visible image forming device that forms a visible image on the medium.

6. The image forming apparatus according to claim 5, further comprising:

a cooling path forming unit in which the cooling path is formed, and the cooling path forming unit supporting the endless member; and an exterior member that is disposed on an outer side of the cooling path forming unit and is supported by an image forming apparatus body, the exterior member including an exterior exhaust port that is disposed at a position out of alignment with a position of a cooling exhaust port of the cooling path.

7. The image forming apparatus according to claim 6, further comprising:

a light shielding member that is disposed at the exterior exhaust port to shield outside light.

8. The image forming apparatus according to claim 5, further comprising:

a medium transport path that is formed on an opposite side to the medium transport member in a state in which the cooling path formed along a surface of the endless member is located between the medium transport path and the medium transport member; and a gas outflow path that allows the gas to flow from the cooling path to the medium transport path.

* * * * *